United States Patent [19]

Deshpande

[11] 4,112,841

[45] Sep. 12, 1978

[54] RESILIENT LITHOGRAPHIC MASTERS FOR DIRECT PRINTING

[75] Inventor: Narayan V. Deshpande, Penfield, N.Y.

[73] Assignee: Xerox Corporation, Stamford, Conn.

[21] Appl. No.: 757,714

[22] Filed: Jan. 7, 1977

Related U.S. Application Data

[62] Division of Ser. No. 601,005, Aug. 1, 1975, abandoned.

[51] Int. C.[2] ..... B41F 7/00; B41F 13/08; B41L/17/02

[52] U.S. Cl. ..... 101/141; 101/450; 101/454; 101/460; 101/376; 428/909; 101/401.1

[58] Field of Search ..... 101/450–457, 101/460–463, 467, 468, 470, 471, 376, 415.1, 141, 401.1; 428/909

[56] References Cited

U.S. PATENT DOCUMENTS

| | | | |
|---|---|---|---|
| 1,669,416 | 5/1928 | Heubner | 101/456 |
| 2,020,479 | 11/1935 | Sites | 101/150 |
| 2,021,894 | 11/1935 | Morse | 101/415.1 |
| 2,042,003 | 5/1936 | Huebner | 101/454 |
| 2,294,879 | 9/1942 | Affelder | 101/415.1 |
| 3,045,595 | 7/1962 | Gurin | 428/909 |
| 3,126,825 | 3/1964 | Tofano | 101/415.1 |
| 3,663,289 | 5/1972 | Newman | 101/453 |
| 3,669,706 | 6/1972 | Sanders | 101/470 |
| 3,676,282 | 7/1972 | Volmer | 428/909 |
| 3,894,873 | 7/1975 | Kobayashi et al. | 96/33 |
| 3,903,794 | 9/1975 | Grupe et al. | 101/376 |
| 3,949,142 | 4/1976 | Doggett | 101/466 |
| 3,983,287 | 9/1976 | Goossen et al. | 101/401.1 |
| 4,009,660 | 3/1977 | Wells | 101/463 |

FOREIGN PATENT DOCUMENTS

| | | | |
|---|---|---|---|
| 1,145,555 | 3/1969 | United Kingdom | 29/132 |

*Primary Examiner*—Clyde I. Coughenour

[57] ABSTRACT

Lithographic masters for improved image quality in direct printing process are provided. The masters are formed with a relatively soft elastomeric or resilient layer on a suitable supporting master substrate. An image layer of up to 2.5 microns is supported by the resilient layer. A resilient blanket supports the printing master or receiver sheet.

2 Claims, 9 Drawing Figures

DEFORMABILITY OF A THIN LAYER OF ELASTOMER ON A RIGID MASTERS SUBSTRATE

EFFECT OF THE HARD IMAGE LAYER THICKNESS VARIATION

EFFECT OF CHANGE IN THE ELASTOMER HARDNESS ON THE DEFORMABILITY OF A 3-LAYER STRUCTURE

EFFECT OF VARYING THE INK FILM THICKNESS
ELASTOMER THICKNESS IS 50μ AND TONER THICKNESS IS 10μ

ANALYSIS OF DIFFERENT MASTER SUBSTRATE MATERIALS SHOWING THAT THE SUBSTRATE HAS VERY LITTLE EFFECT WHEN THE MASTER IS MOUNTED ON A RIGID SURFACE

EFFECT OF THE ELASTOMERIC BLANKET UNDER THE MASTER SUBSTRATE. SUBSTRATE SELECTION IS IMPORTANT IN THIS CASE.

DEFORMABILITY OF THE PAPER WHEN SUPPORTED BY A HARD AND A SOFT LAYER. A DRAMATIC IMPROVEMENT IN THE CONFORMABILITY CAN BE EXPECTED WHEN THE PAPER IS ON THE BLANKET.

EFFECT OF COMPRESSIBILITY OF THE ELASTOMER: PAPER MASTER

RESILIENT LITHOGRAPHIC MASTERS FOR DIRECT PRINTING

This is a division, of application Ser. No. 601,005, filed Aug. 1, 1975, now abandoned.

BACKGROUND OF THE INVENTION

Most of the printing in lithography is done in the two fluid offset mode. A lithographic master is generally mounted on a rigid master cylinder. The image areas of the master are ink receptive while the non-image areas are water receptive. First a fountain solution is applied to the plate to wet the background and then an oil base ink is used to ink the image area. A large number of rollers are used in the inking train for proper distribution and control of ink. Because of the presence of water in the background, the oil base ink is repelled from the non-image areas. A proper balance of water and ink is necessary to attain this response. The inked master comes in contact with the blanket cylinder where the image is transferred to a relatively soft elastomeric blanket. The paper passes between the blanket cylinder and the impression cylinder and the image is offset from the blanket to the paper. There are advantages in having the intermediate blanket for image transfer. First it is responsible for the excellent image quality, second it helps in increasing the plate life and third it permits the use of a wide variety of printing stock. Good image quality is obtained even with rough paper because of the resiliency of the blanket.

These advantages are lost when prints are directly made from the planographic master to the paper (direct printing). The degradation of halftone scales and poor solid area image fill-in are the immediate consequences.

Even in offset lithographic printing it is known that image quality strongly depends on paper quality. Most of the high quality printing is done on smooth, coated papers. This dependence becomes more significant in the direct printing mode. A close examination of the paper surface shows that the surface is very rough. The peak to peak variation in surface profile could be as large as 20 $\mu$ depending on the type of paper examined. In order to have true reproduction of the image from the master to the paper it is necessary to have complete contact between the two surfaces. Either the image surface or the paper surface has to deform to assure conformity between the surfaces. This kind of deformation cannot be expected from the paper itself, although there might be a very small contribution through bending over large distances. In offset lithography the necessary deformation is provided by the blanket. Conventional lithographic masters are relatively hard and when they are used for direct mode printing only the high spots on the paper surface receive ink giving a very mottled effect in the image area. In the offset mode each of the halftone dots is reasonably uniform while in the direct mode the dots are very non-uniform. This non-uniformity of the printed dot results in the degradation of halftones. For solid area prints direct mode printing reduces the ink coverage by leaving open white spots in the image area. One can see under a microscope that these small dots correspond to valleys in the paper surface. Some of these voids are as large as 4 to 5 mils in diameter making them visible at a normal viewing distance.

It is clear from this discussion that a high quality direct printing master must have conformability to the paper surface variation and this invention is directed towards defining structural requirements for such a master.

BRIEF DESCRIPTION OF THE INVENTION

It has now been discovered that prints of improved quality can be obtained in planographic direct printing by employing a master with a resilient or elastomeric layer supported on a suitable master substrate with or without a surface image layer. More particularly, it has been found that the use of such a master having a resilient layer results in prints of enhanced image fill-in comparable in quality to that obtained by offset printing. Other benefits will be apparent from the following detailed description.

DETAILED DESCRIPTION OF THE INVENTION

The high quality direct printing master will generally comprise a supporting substrate, an elastomeric layer, a layer of the background material and a layer of the image material. Various combinations of these different layers are possible, such as a single material may perform the functions of more than one layer thereby reducing the number of layers. It will be shown through theoretical analysis that the thickness of various layers and the elastic properties of the materials must be selected in an appropriate manner. Suitable master materials, methods of imaging and other aspects of the invention will also be described in detail.

At the time of printing an inked image is brought in contact with the paper to which the image is to be transferred. Due to the roughness of the paper, the contact between the two surfaces is not complete and its extent depends upon the amount of applied force and the deformability of the two surfaces under that force. An incomplete contact gives rise to a non-uniform pressure distribution. If the actual pressure distribution is known, it can be resolved in periodic components through the use of well-known transforms in applied mathematics. If the image surface is capable of deforming at all the possible periodicities, it would conform to the paper surface. Significant periodicities in the paper surface non-uniformity are in the range from 0 to about 2 mm. The master structure must provide the necessary deformation over this range while the master supporting structure would provide the necessary deformation beyond the 2 mm periodicity. Because of the multilayered structure, various parameters affect the deformability of the image surface. The effect of these parameters and their interactions determined through a theoretical analysis will be explained with the help of the attached Figures.

Figure 1:
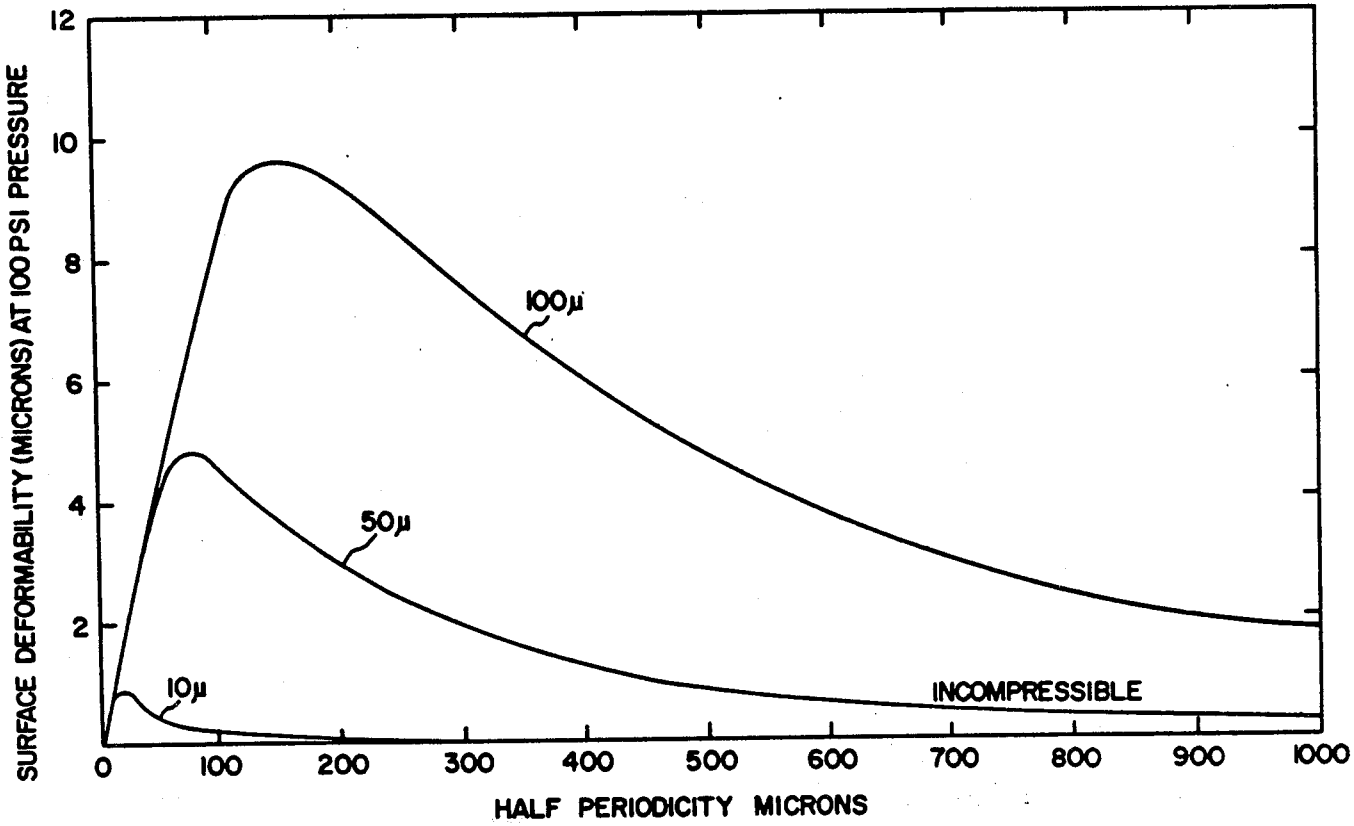
FIGS. 1–8 are graphs depicting the effect of different materials and conditions on master deformability.

FIG. 1 shows the surface deformability of a single elastomeric layer on some suitable master substrate. The elastomer is assumed to have a Young's modulus of 500 psi. It shows that the thickness of the elastomeric layer is highly significant. It also shows the necessity of housing an elastomeric layer over a relatively hard master substrate. The surface of the elastomeric layer carries the image which is ink receptive and the background is ink repellent. Some examples of the imaging methods which give such a configuration will be described later.

Figure 2:
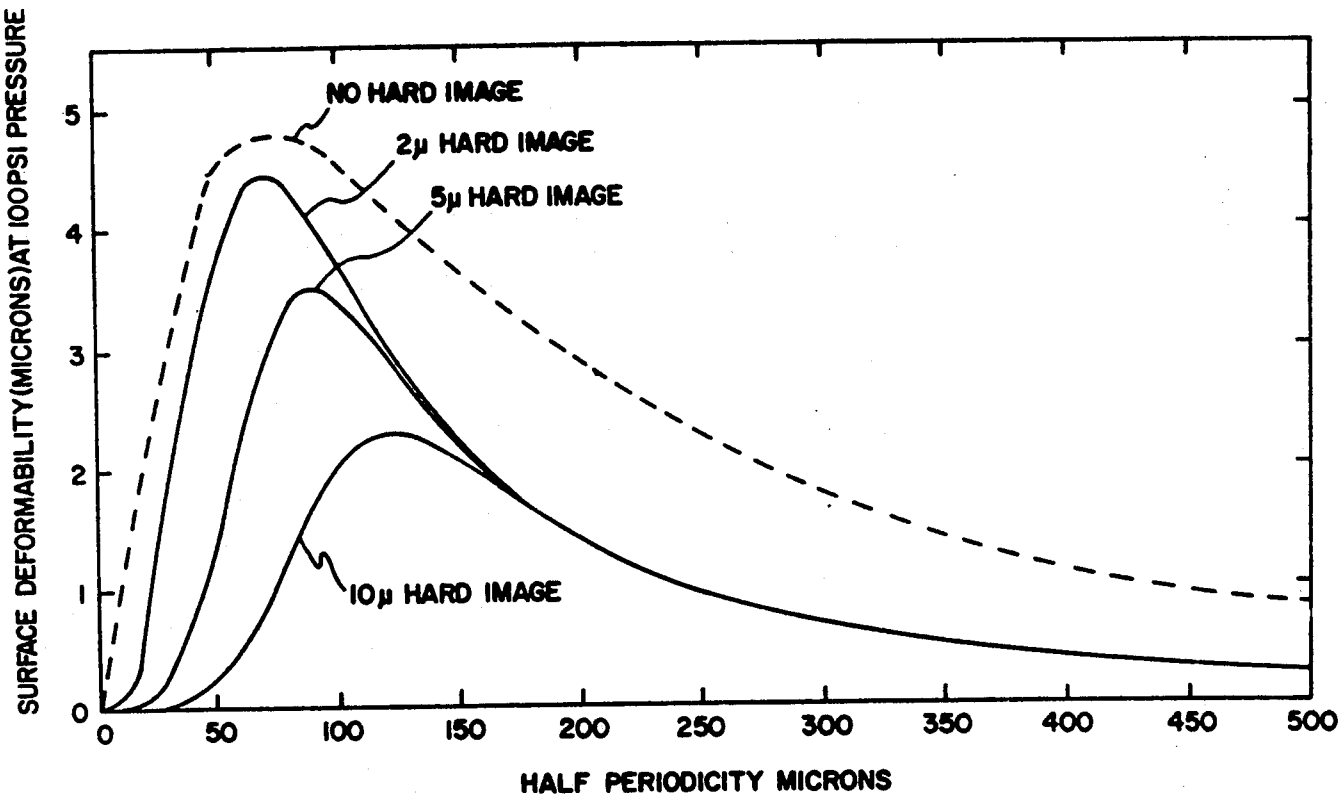

FIG. 2 shows the effect on surface deformability of having a hard image layer (e.g. toner with elastic modulus of $3 \times 10^5$ psi) on top of the elastomer layer. Only a 50 micron elastomer thickness with a Young's of 500 psi is considered. The figure shows that as soon as a hard image layer, no matter how thick it is, is placed on the elastomer, the effectiveness of the elastomer in providing the conformity is reduced. With thinner image thicknesses some improvement is possible at low periodicities.

Figure 3:
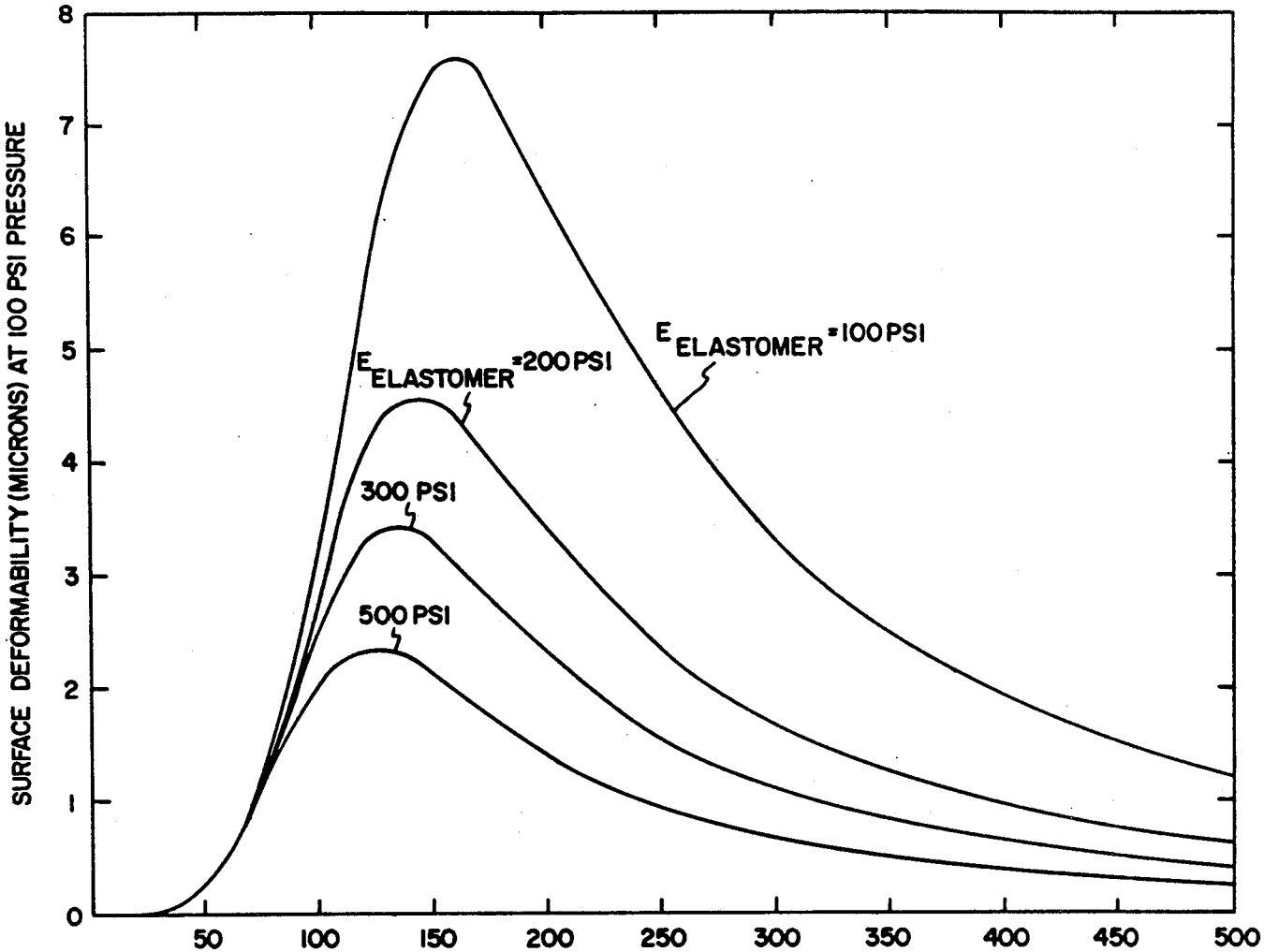

FIG. 3 shows the effect of changing the elastomer Young's modulus, which is a measure of its hardness, in the presence of a 10 $\mu$ thick hard image layer. The elastomer layer is considered to be 50 $\mu$ thick. It shows that changing the elastic constant for the elastomer changes response only at higher periodicities. It is clear then from FIGS. 2 and 3 that a proper combination of the hard image layer thickness and the elastomer hardness is necessary to obtain the desired deformability over the total spectrum of periodicities of interest.

Figure 4:
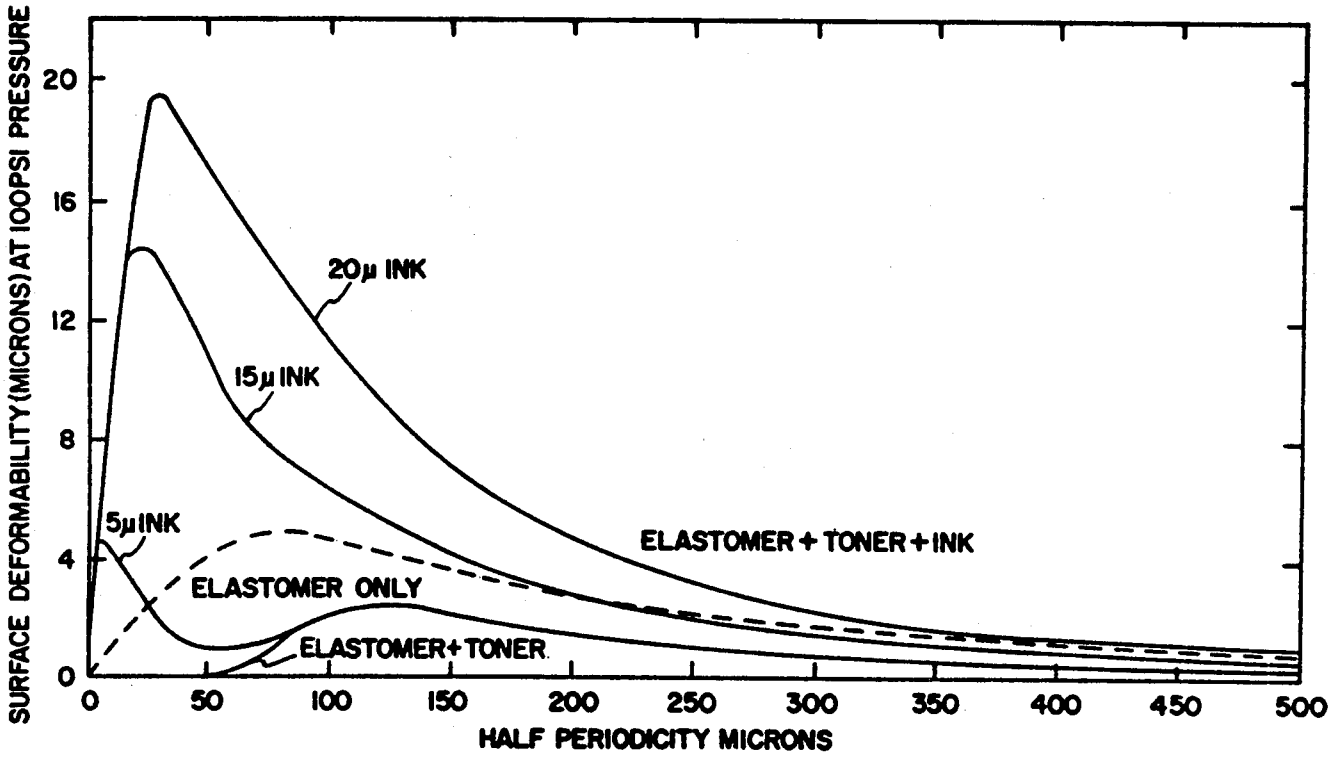

FIG. 4 shows the effect of having an ink layer on a 10$\mu$ thick hard image layer with a 50 $\mu$ thick elastomeric underlayer having a Young's modulus of 500 psi. The ink layer is considered as a soft elastomeric layer with a Young's modulus of 50 psi. The image layer has a Young's modulus of $3 \times 10^5$ psi. The lithographic ink is highly viscous and it also has elasticity. The behavior of such a viscoelastic material strongly depends on the relationship between the characteristic time, called the relaxation time, for the ink and the dwell time. If the dwell time is equal to the relaxation time the viscoelastic material behaves as an elastic solid. Such is the situation for high speed lithographic printing. FIG. 4 shows that the ink layer responds to very low periodicities, that is to very high frequency surface variation. Higher ink film thickness would be required to reduce the effect of the hard image layer.

So far, only the master structure has been discussed. The effect of the master substrate and the method of supporting the master will now be discussed.

Figure 5:
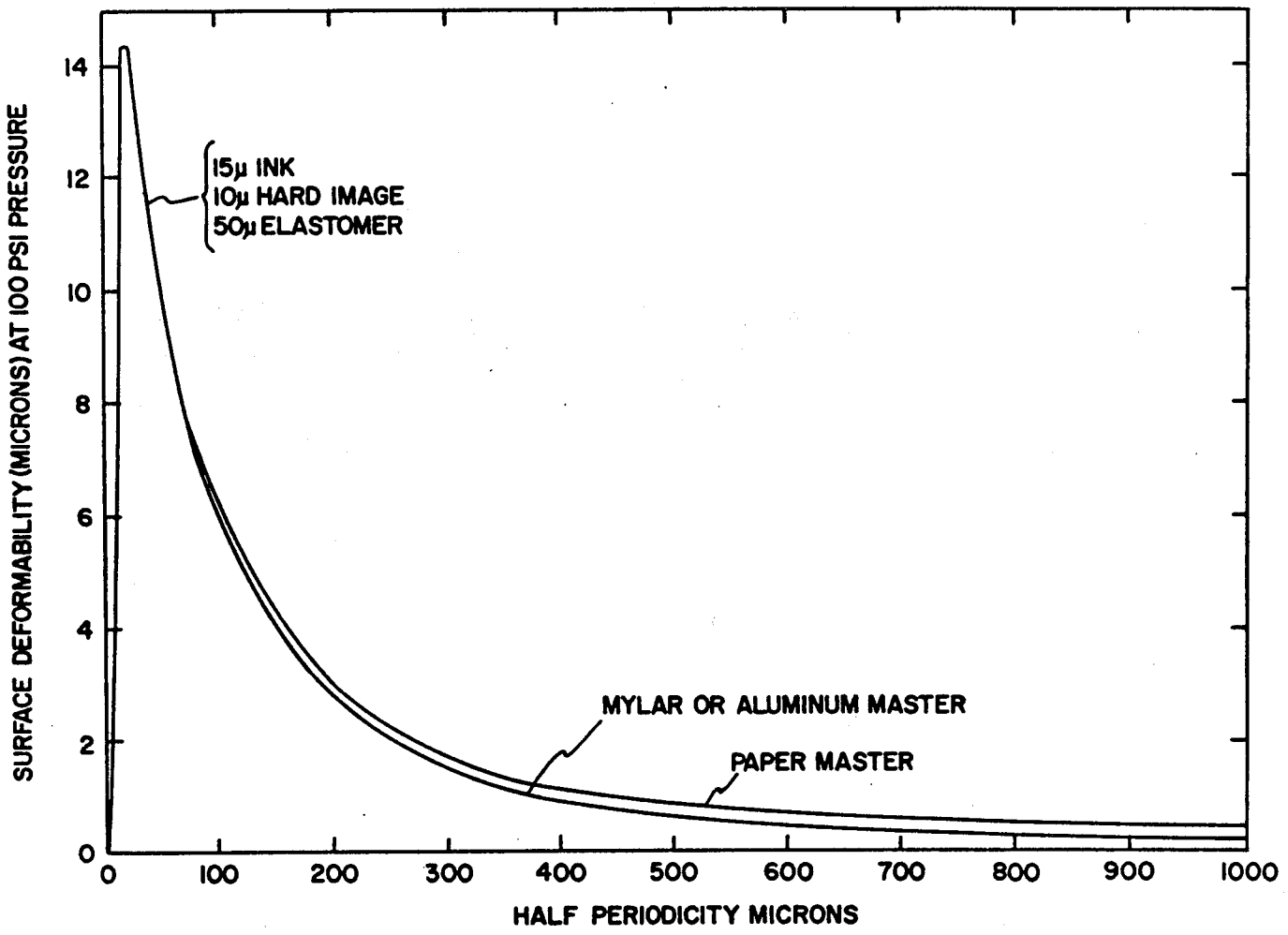

FIG. 5 shows the effect of the master mounted on a hard surface. It shows that the master substrate has no effect on the deformability if the master is mounted on the hard surface.

Figure 6:
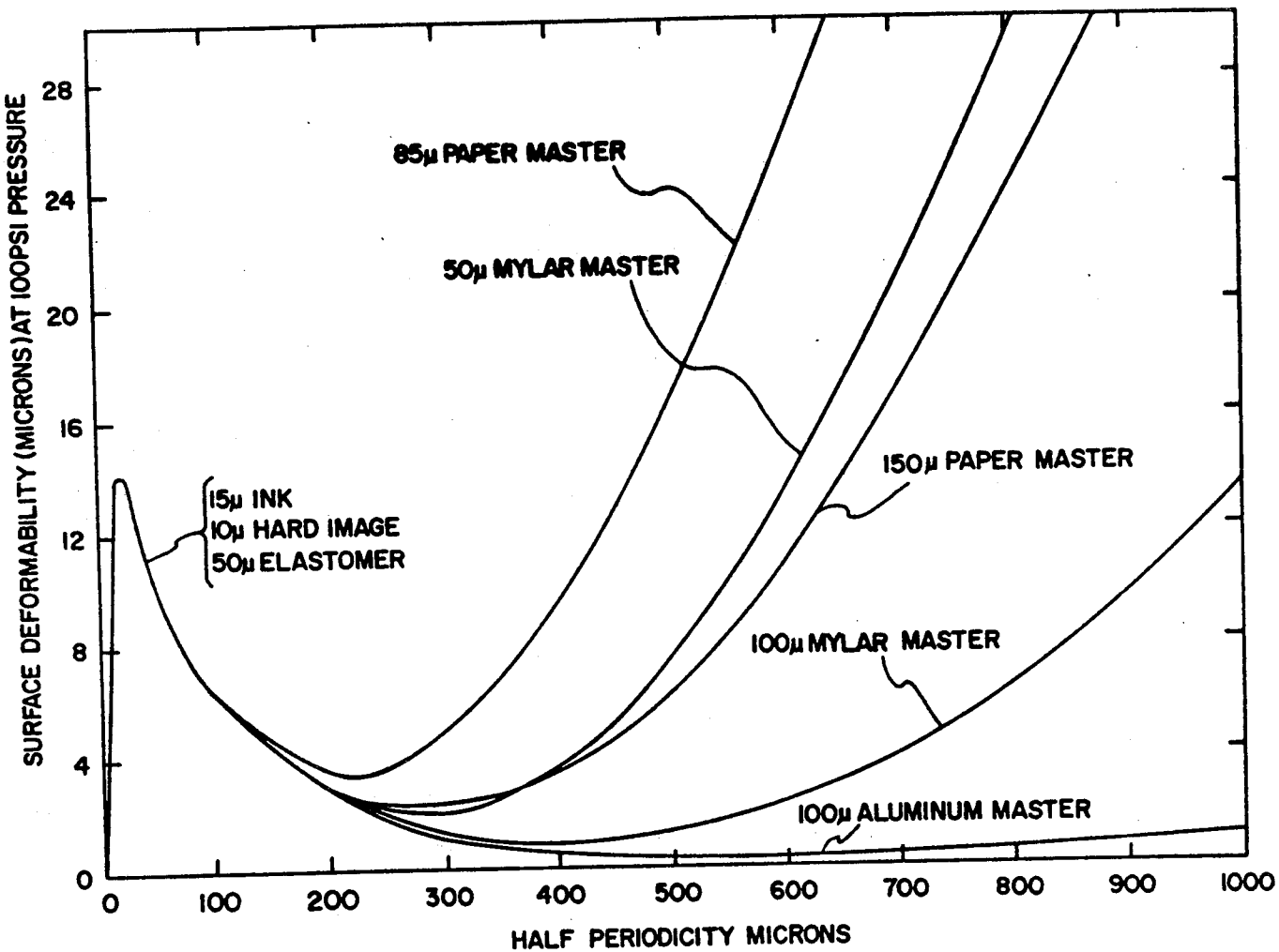

FIG. 6 shows the effect of mounting the master on a soft surface such as a conventional blanket. In this configuration, the selection of material for the master substrate is important.

Figure 7:
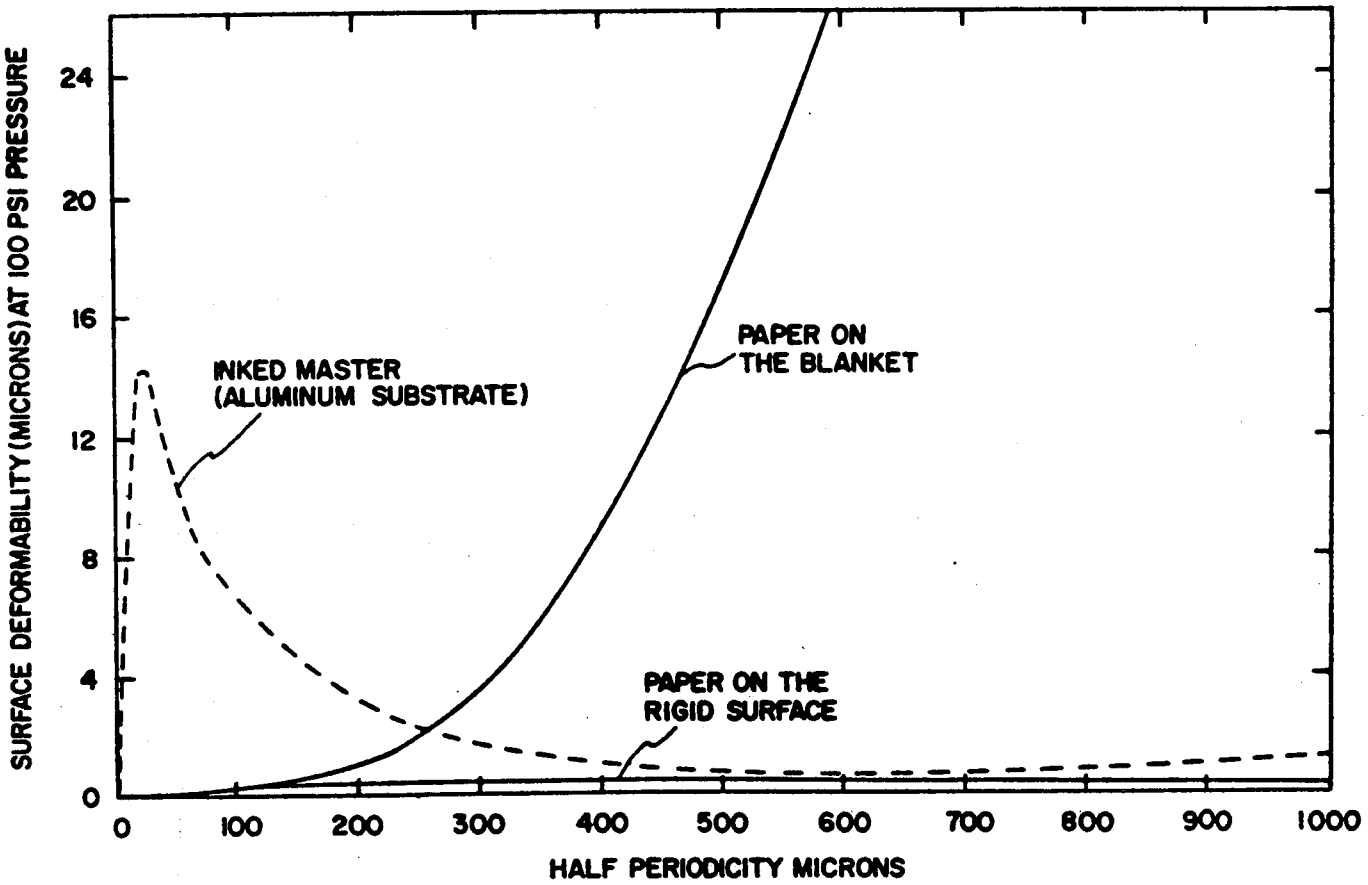

FIG. 7 shows the effect of support characteristic for the printing paper. If the paper is on a hard surface, it does not deform to aid in the conformability. However, if the paper is supported on a soft surface such as a blanket, it contributes significantly to conformity.

Figure 8:
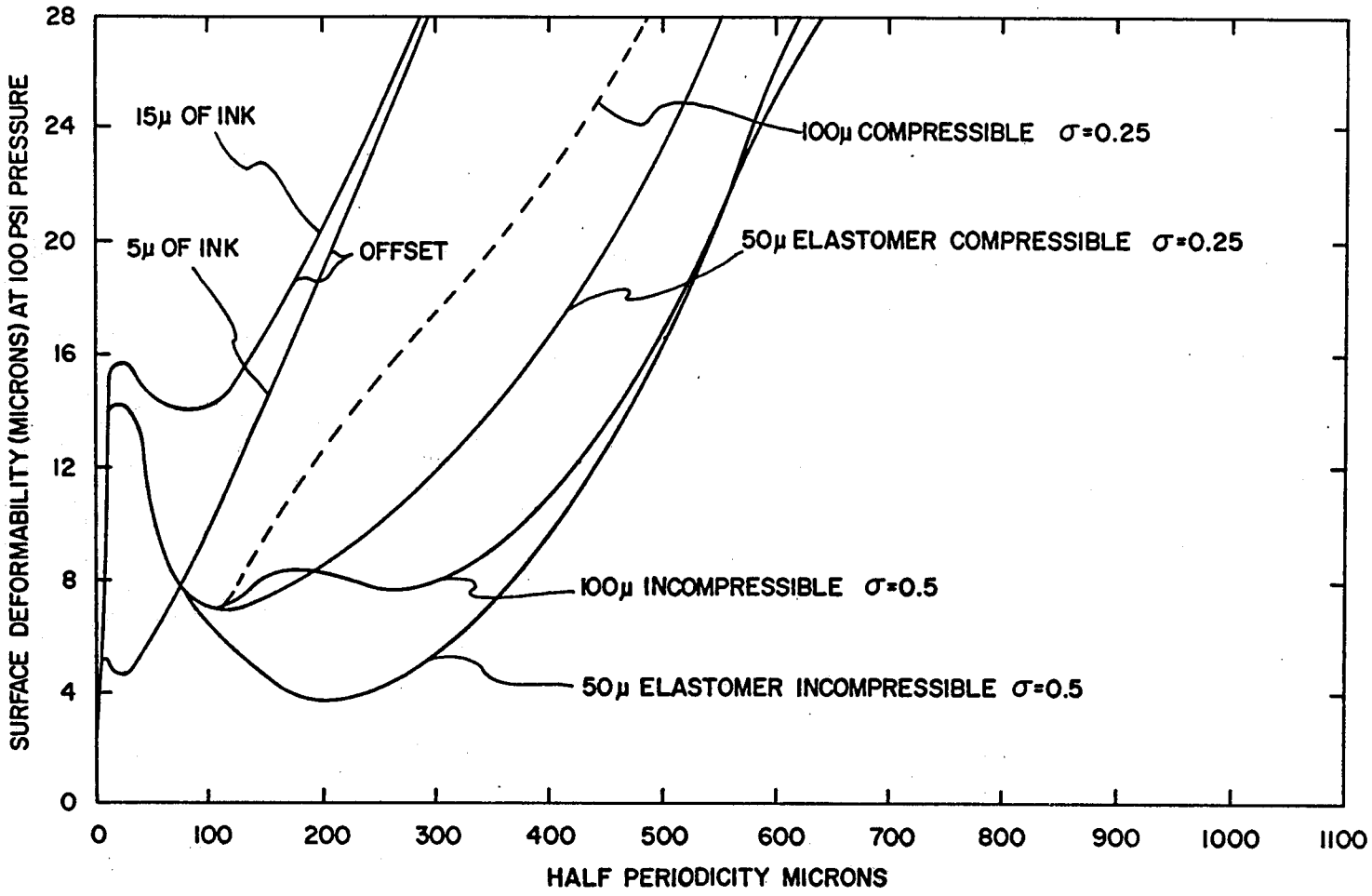

FIG. 8 shows the effect of compressibility of the elastomeric layer on the master substrate. The ink layer is 15 $\mu$ thick and the hard image layer is 10 $\mu$ thick. It shows that a 50 $\mu$ thick compressible layer performs better than a 100 $\mu$ thick incompressible layer. For comparison purposes, the deformability provided by a blanket in the offset mode of printing is shown. With a 100 $\mu$ thick compressible elastomer on a 85 $\mu$ thick paper substrate and imaged with 10 $\mu$ thick hard image and mounted appropriately one can get very close to the offset printing conditions in a direct printing mode.

Figure 9:
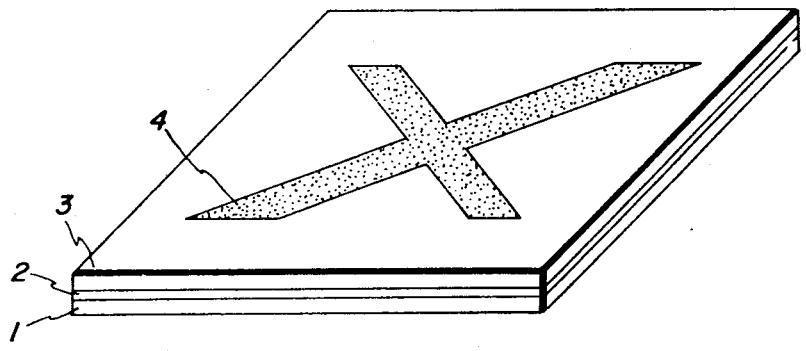
FIG. 9 depicts the structure of the printing master of the invention.

FIG. 9 depicts the printing master of the invention in which 1 is a suitable supporting master substrate, 2 is a resilient layer between 25 and 200 microns, 3 is a surface layer and 4 an image layer of up to 2.5 microns.

Having discussed the theoretical background of the invention, suitable master materials, methods of imaging and other aspects of the invention will now be described in detail.

Master substrates which can be employed to prepare the printing master are materials to which the resilient layer can be adhered and which possess sufficient heat and mechanical strength to permit use under widely varying printing and handling conditions. Exemplary of suitable materials are paper, metals such as aluminum and plastics such as polyester, polycarbonate, polysulfone, nylon and polyurethane.

The resilient layer should be formed of a material which is either compressible or incompressible and which has a thickness of at least 25 microns and preferably between about 50 and about 150 microns. There is no upper limit on the thickness of the resilient layer but the improvement gained for very thick elastomers in excess of 200 microns may not justify the added expense of the additional material. Compressible materials are those which exhibit change in volume when compressed and substantially no lateral displacement and are preferred materials. Incompressible materials are those which have substantially no volume change and exhibit lateral displacement. Suitable materials have a Young's modulus of between about 200 and about 1000 psi and/or a Shore A durometer of between about 30 and about 80. Exemplary of suitable incompressible materials are natural rubber, polyisoprene, polybutadiene, poly(ethylenevinyl acetate), polyurethane elastomers and silicone elastomers such as poly(dimethyl siloxane). Examples of compressible elastomers are polystyrene and polyurethane foams.

The resilient layer may constitute the surface layer of the printing master when a silicone elastomer is employed because the elastomer is ink releasing and may form the nonimaged areas. Imaged areas may be formed by depositing and fusing a particulate ink-accepting material such as a toner used in the art of electrophotography, preferably by depositing the image material on the elastomer gum in an uncured or semicured condition so that the imaging material can be more firmly adhered thereto when the gum is cured to an elastomeric condition. In addition, the particulate imaging material may be removed from the elastomer after it is cured by washing with a suitable solvent to reveal ink-accepting porous depressions corresponding to the deposited imaging material. Alternatively, an image can be formed by selectively imagewise curing the elastomer to an ink-accepting resinous condition. Other means will be apparent to one skilled in the art. Materials which are not ink releasing such as the polyurethanes can be imaged by silver diffusion transfer, e.g. British Pat. No. 1,129,366, by thermography, e.g. U.S. Pat. No. 3,299,807, or by a diazo method, e.g. U.S. Pat. No. 3,136,636. Generally, the image will have a relief from 0 to 15$\mu$. Other configurations will be apparent to one skilled in the art, but the number of layers and their thicknesses must be controlled such that the resilient layer is able to conform to conventional paper during the printing operation.

If desired, a plurality of layers can be employed to form the master provided that the layers are not so thick and formed of a number of relatively rigid materials so as to inhibit the deformability of the elastomer layer. In addition, the preferred thickness of the elastomer layer will depend on the elastomer composition and printing pressure. In addition, image thickness will have a strong influence on the print quality for a given elastomer thickness. For example, employing a conformable master which had an elastomer sublayer Shore A durometer of 40, an elastomer thickness of 70 microns, an image thickness of 0.5 micron for printing with 12 microns of ink at a printing speed of 30 inch/sec., the image fill-in was excellent. When, however, the image thickness was increased to 2.5 microns, the amount of image fill-in was substantially reduced. It has been found that the best results are achieved with conformable masters which have a sublayer elastomer of 40 to 60 Shore A durometer and a thickness of between 50 and 150 microns with a hard image layer of from 0 to 2.5 microns.

The masters can be employed on conventional printing equipment. For best results, however, a conventional blanket about 65 mils thick having a rubber surface layer and a Shore A durometer between about 70 and 90 should be placed between the master and the master cylinder or on the paper impression cylinder. If the blanket is mounted on the impression cylinder, then the master cylinder can be rigid. If the blanket is mounted on the master cylinder, then the impression cylinder can be rigid. Blankets may be mounted on both the cylinders, however, their thickness may be less than 65 mils. If the blanket is underneath the master, then the master should have a soft substrate such as paper or Mylar plastic film of about 2 to 6 mils thick. Aluminum and other nonresilient master substrates can be employed, however, when the paper supporting roller is soft.

The following Examples will serve to illustrate the invention and preferred embodiments thereof. All parts and percentages in said examples and elsewhere in the specification and claims are by weight unless otherwise specified.

EXAMPLE I

A direct printing master was prepared as follows: A grained aluminum master substrate (0.006 inch thick) was coated with a urethane rubber (INDPOL monothane A-40) in a 33 percent solution in benzene and containing 1 percent wetting agent employing a bird applicator bar having a 0.006 inch gap. The composite was heated in an air oven for two hours at 265° C to cure and dry the rubber to a dry film of 0.002 inch. A 5 percent solution of cellulose triacetate in a mixture of three parts methylene chloride and one part methyl alcohol was coated onto the rubber layer employing a 0.003 gap bird applicator bar up to a wet thickness of 0.001 inch. The layer was allowed to dry at ambient temperature for one hour to a dry film thickness of 0.00005 inch. A layer of Kodak KPR III photoresist was then applied over the cellulose triacetate layer employing a 0.003 gap bird applicator bar and the plate allowed to dry at ambient temperature for 24 hours and then heated in an air oven for 10 minutes at 250° F. The master was then exposed for 3 minutes employing a NuAra exposure frame with a carbon arc and a contact negative. The unexposed photoresist was removed with a 50/50 blend of methylethyl ketone and trichloroethylene. The hydrophobic triacetate layer was then rendered hydrophilic by treatment with a 5 percent solution of sodium hydroxide in a 50/50 mixture of ethanol and water by submerging the plate for 1 minute in said solution. The resultant master was then mounted and operated on a Davidson Dual-a-matic 560 Duplicator operating in the direct mode and prints obtained comparable in quality to prints obtained by the offset mode with conventional masters.

EXAMPLE II

The general procedure of Example I was repeated but for the exceptions that a copolymer of methyl vinyl ether and maleic anhydride (Gantrez AN-169 manufactured by GAF Corporation) was substituted for the cellulose triacetate layer. The copolymer was dissolved in water to provide a 5 percent by weight solution and then a curing agent added of nonylphenoxy poly(ethyleneoxy) ethanol sold by GAF Corporation as Igepal CO-630. After the KPR photoresist layer was applied and imaged, the master was developed by spraying with methylethyl ketone and the copolymer layer hardened by heating the plate for two hours at 250° F. The plate was then etched to convert the exposed areas to a hydrophilic condition by immersion for 1 minute in a 10 percent solution of Alkanox detergent in water. When the resultant master was operated in the direct mode on a printing press, similar results were achieved to those of Example I.

EXAMPLE III

The general procedure of Example I was repeated but for the exception that the plate was etched prior to coating of the photoresist and the photoresist employed was a wipe-on diazo which was air dried for 30 minutes.

Having described the present invention with reference to these specific embodiments, it is to be understood that numerous variations can be made without departing from the spirit of the invention and it is intended to encompass such reasonable variations or equivalents within its scope.

What is claimed is:

1. In a direct printing process of transferring an inked image directly from the printing master to a receiving sheet, the improvement comprising employing a master consisting essentially of a suitable supporting substrate, a resilient layer between 25 and 200 microns on said substrate, said layer having a Shore A durometer of between 30 and 80, a surface layer and an image layer of up to 2.5 microns and supporting the receiver sheet by a resilient blanket having a Shore A durometer between about 70 and 90.

2. In a direct printing process of transferring an inked image directly from the printing master to a receiving sheet, the improvement comprising employing a master consisting essentially of a suitable supporting substrate, a resilient layer between 25 and 200 microns on said substrate, said layer having a Shore A durometer of between 30 and 80, a surface layer and an image layer of up to 2.5 microns and supporting the printing master by a resilient blanket having a Shore A durometer between 70 and 90.

* * * * *